US005479864A

United States Patent [19]

Kemp

[11] Patent Number: 5,479,864

[45] Date of Patent: Jan. 2, 1996

[54] TRADER DESK NOSING ASSEMBLY

[75] Inventor: John Kemp, Columbia, S.C.

[73] Assignee: Specialized Banking Furniture International, Newberry, S.C.

[21] Appl. No.: 231,236

[22] Filed: Apr. 22, 1994

[51] Int. Cl.[6] ..... A47B 17/00

[52] U.S. Cl. ..... 108/27

[58] Field of Search ..... 108/27, 157; 312/140.1, 312/140.3

[56] References Cited

U.S. PATENT DOCUMENTS

| | | | |
|---|---|---|---|
| 2,614,014 | 10/1952 | Stanitz | 108/27 |
| 2,646,326 | 7/1953 | Stanitz | 108/27 |
| 2,940,805 | 6/1960 | Nordmark | 108/27 |
| 2,980,477 | 4/1961 | Hansen | 108/27 |
| 3,055,722 | 9/1962 | Chase et al. | 108/27 |
| 3,294,353 | 12/1966 | Rowe | 108/27 X |
| 3,869,106 | 3/1975 | Gregov | 108/27 X |
| 4,858,413 | 8/1989 | Grushka | 108/27 |
| 5,208,084 | 5/1993 | Rutz | 108/27 X |
| 5,253,932 | 10/1993 | Nesovic | 108/27 X |
| 5,348,384 | 9/1994 | Hull et al. | 108/27 X |
| 5,424,108 | 6/1995 | Whetstone . | |

OTHER PUBLICATIONS

Polyform Edgecasting, Surface forming, and Bonding System, Sep. 29, 1992, Author: RW Specialized Machines, Ltd—Great Brittain.

*Primary Examiner*—Kenneth J. Dorner
*Assistant Examiner*—Rodney B. White
*Attorney, Agent, or Firm*—Hardaway Law Firm

[57] ABSTRACT

A nosing assembly (10) is provided for a desk work surface (14) having a front end portion (12) and comprises a lower block (18) attached to the underside of the desk work surface, the lower block having a first exterior surface (19). A nosing (22) is attached to the first exterior surface, and substantially surrounds and conforms to the first exterior surface. The desk work surface is thereby provided with a nosing to protect the desk work surface and users thereof.

12 Claims, 2 Drawing Sheets

TRADER DESK NOSING ASSEMBLY

BACKGROUND OF THE INVENTION

The present invention relates to a nosing for a desk work surface, particularly as used in connection with a trader desk.

It has been known to provide a trader desk frame with a work surface, such as that disclosed in copending application Ser. No. 08/162,491, filed Dec. 3, 1993, the disclosure of which is incorporated herein by reference. The front end of the desk work surface, typically being a planar board, contains sharp edges and corners which pose a hazard to users walking closely to the front of the desk. Moreover, as the desk frame disclosed in the above-referenced application is adaptable to a variety of arrangements with respect to other desk frames, it is contemplated that the desk frame will be moved about on a floor for such a period of time until its desired position in a particular arrangement has been reached. Such movement increases the likelihood that the front of the work surface on the desk frame may be bumped by a wall, another desk frame, or another piece of office furniture, thus marring the appearance of any of these objects.

SUMMARY OF THE INVENTION

It is an object of the present invention to provide a means for protecting a work surface of a desk and users thereof.

It is a further object of the present invention to provide a nosing assembly which is easily manufactured to assume a variety of shapes.

These as well as other objects are accomplished by a nosing assembly for a desk work surface having an underside and a front end portion with a first exterior surface, comprising a lower block having a second exterior surface, the lower block attached to the underside of the desk work surface, and a nosing attached to the first and second exterior surfaces, the nosing substantially surrounding and conforming to the first and second exterior surfaces. The desk work surface is thereby provided with a nosing to protect the desk work surface and users thereof.

DETAILED DESCRIPTION

In accordance with this invention, a nosing assembly can be constructed which provides protection for a desk work surface and users thereof.

Figure 1:
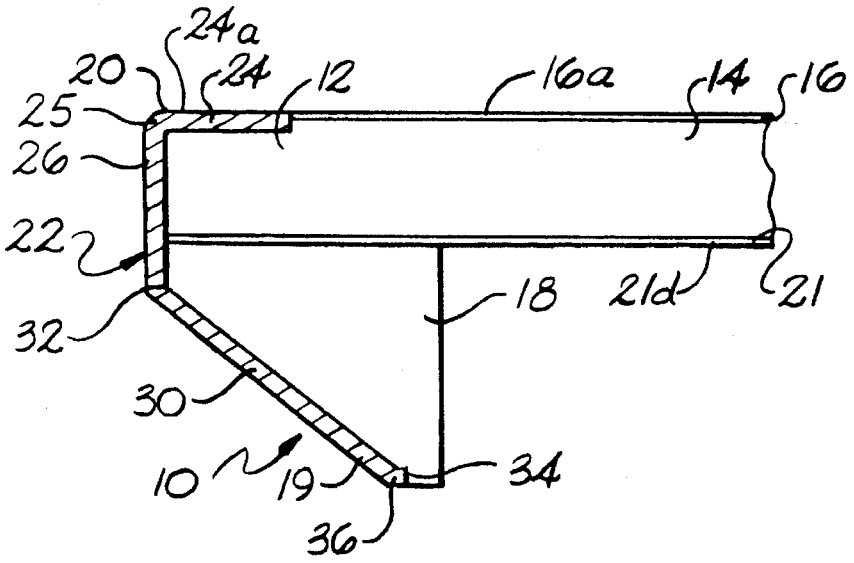
FIGS. 1–5 are side elevation views of a nosing assembly constructed according to the present invention, each figure illustrating a different embodiment thereof.

FIG. 1 illustrates an embodiment of the present invention wherein a nosing assembly 10 protects a front end portion 12 of a desk work surface 14. The desk work surface 14 is preferably constructed of medium-density fiberboard or particle board, and it may be provided with a conventional top laminate layer 16, which may be constructed of a variety of materials, such as a type of plastic known under the trademark Formica®. The exterior surface 20 of front end portion 12 is preferably recessed with respect to the exterior surface 16a of top laminate layer 16. The desk work surface 14 may be also provided with a corresponding bottom laminate layer 21, such that the exterior surface 21*d* thereof preferably forms the underside of desk work surface 14.

A lower block 18 having an exterior surface 19 is attached to the underside 21*d* of desk work surface 14 by any suitable conventional means, such as gluing. Lower block 18 is preferably constructed of wood, although other suitable materials are contemplated by the present invention. A polyform nosing 22 is attached to the exterior surfaces 20 and 19 of front end portion 12 and lower block 18, respectively. As can be seen in FIG. 1, nosing 22 substantially surrounds and conforms to these exterior surfaces. Consequently, nosing 22 comprises a horizontal portion 24, a vertical portion 26 integral with horizontal portion 24 and extending vertically downwardly from an end 25 of horizontal portion 24, and a sloped portion 30 integral with vertical portion 26 and extending downwardly at an angle to vertical portion 26 from an end 32 thereof, terminating in a free end 34. In this embodiment, vertical portion 26 is longer than horizontal portion 24, and a section of the sloped portion 30 proximate its free end 34 is bent to form a lip 36. preferably, the exterior surface 24*a* of horizontal portion 24 is flush with the exterior surface 16*a* of laminate layer 16, owing to the recessed relation of exterior surface 20 to the exterior surface 16*a*.

In the foregoing embodiment, as well as in the embodiments to be described below with regard to FIGS. 2–5, a nosing is constructed by exposing a portion of the exterior surfaces of a front end portion of a desk work surface and of a bare lower block to a mold cavity, injecting polyurethane or similar material into the mold, and removing the mold once the polyurethane has set. The portions of these exterior surfaces which were exposed to the mold cavity are thereby provided with a nosing.

It is noted that, like the embodiment described with regard to FIG. 1, the respective nosings of each embodiment described below substantially surround and conform to their associated exterior surfaces. Moreover, the exterior surface of each horizontal portion or leg of a nosing is preferably flush with the exterior surface of a laminated layer of an associated desk work surface. Attachment means and composition of nosing assembly elements are also the same for each of these embodiments.

Figure 2:
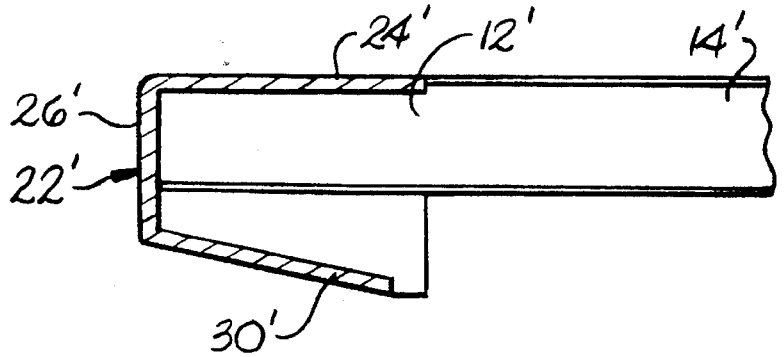

FIG. 2 illustrates an embodiment similar to FIG. 1, except that the horizontal portion 24' of nosing 22' is longer than the vertical portion 26'. Additionally, sloped portion 30' has no lip, it may have a length differing from that of sloped portion 30 (FIG. 1), and it may make less of an angle with vertical portion 26' than that made by sloped portion 30 with vertical portion 26.

Figure 3:
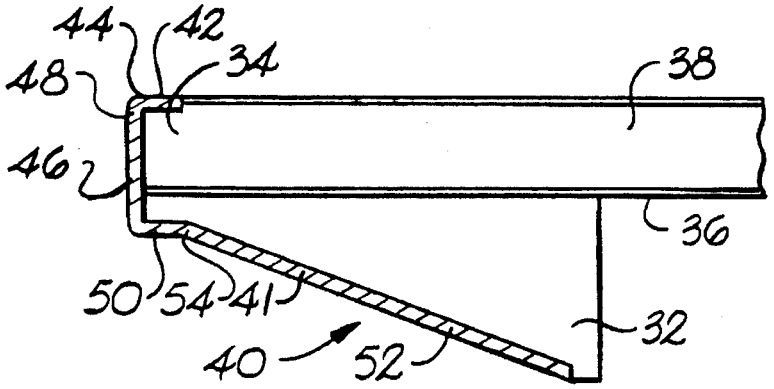

FIG. 3 illustrates another embodiment of a nosing assembly. Here, a lower block 32, having a first exterior surface 41, is attached to an underside 36 of a desk work surface 38, which includes a front end portion 34 having a second exterior surface 42. A nosing 40, conforming to exterior surfaces 41 and 42, comprises a first horizontal portion 44 extending frontwardly, a vertical portion 46 integral with the first horizontal portion 44 and extending vertically downwardly from an end 48 of first horizontal portion 44, a second horizontal portion 50 integral with vertical portion 46 and extending rearwardly, and a sloped portion 52 integral with second horizontal portion 50 and extending downwardly at an angle thereto from an end 54 thereof.

Figure 4:
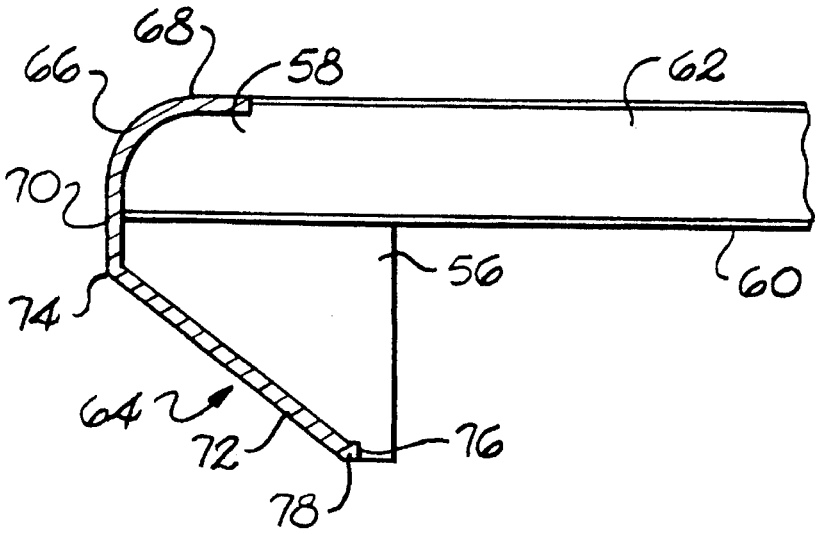

FIG. 4 illustrates yet another embodiment of a nosing assembly. A lower block 56 is attached to an underside 60 of a desk work surface 62. Here, a nosing 64 comprises an arcuate portion 66 including a horizontal leg 68 and a vertical leg 70, and a sloped portion 72 integral with vertical leg 70, the sloped portion 72 extending downwardly at an angle to vertical leg 70 from an end 74 thereof and terminating in a free end 76. In this embodiment, vertical leg 70 is longer than horizontal leg 68, and a section of sloped portion 72 proximate its free end 76 is bent to form a lip 78.

Figure 5:
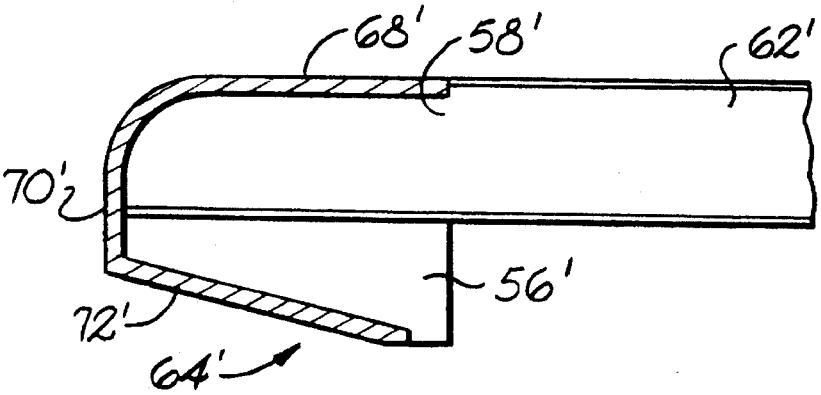

FIG. 5 illustrates an embodiment similar to FIG. 4, except that the horizontal leg 68' of nosing 64' is longer than the vertical leg 70'. Additionally, sloped portion 72' has no lip and may have a length differing from that of sloped portion 72 (FIG. 4), and it may make less of an angle with vertical portion 70' than that made by sloped portion 72 with vertical portion 70.

Figure 6:
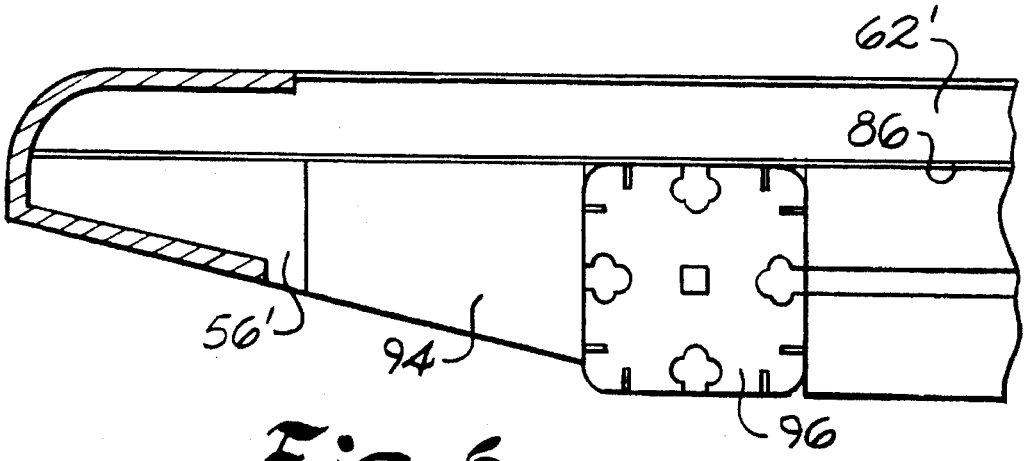
FIG. 6 is a side elevation view of the embodiment illustrated in FIG. 5, shown in relation to additional desk elements.

FIG. 6 illustrates the embodiment of FIG. 5 in relation to other desk elements. A spacer block 94 may be attached to the underside 86 of desk work surface 62' rearwardly of the lower block 56'. Preferably, spacer block 94 is contiguous with respect to both lower block 56' and a cross member 96 of the desk frame bearing the protected desk work surface 62'.

Many variations of the above invention may be apparent to those skilled in the art from the reading of the above description. Such variations are embodied in the spirit and scope of the invention as measured by the following claims.

That which is claimed:

1. In combination, a nosing assembly and a trader desk work surface having an underside and a front end portion with a first exterior surface, comprising:

a lower block having a second exterior surface, said lower block directly attached to said underside of said trader desk work surface; and a nosing attached only to said first and second exterior surfaces, said nosing substantially surrounding and conforming to said first and second exterior surfaces;

whereby said trader desk work surface is provided with a nosing to protect said trader desk work surface and users thereof.

2. The combination set forth in claim 1, wherein said nosing is constructed of polyurethane.

3. In combination, a nosing assembly and a trader desk work surface having an underside and a front end portion with a first exterior surface, comprising:

a lower block having a second exterior surface, said lower block directly attached to said underside of said trader desk work surface; and a nosing attached to said first and second exterior surfaces, said nosing substantially surrounding and conforming to said first and second exterior surfaces said nosing including:

a. a horizontal portion;

b. a vertical portion integral with said horizontal portion, said vertical portion extending vertically downwardly from an end of said horizontal portion; and c. a sloped portion integral with said vertical portion, said sloped portion extending downwardly at an angle to said vertical portion from an end thereof and terminating in a free end;

whereby said trader desk work surface is provided with a nosing to protect said trader desk work surface and users thereof.

4. The combination set forth in claim 3, wherein:

said trader desk work surface is provided with a top laminate layer having a third exterior surface;

said first exterior surface is recessed with respect to said third exterior surface; and said horizontal portion has a fourth exterior surface;

whereby said third exterior surface is flush with said fourth exterior surface.

5. The combination set forth in claim 3, wherein said trader desk work surface is provided with a bottom laminate layer having an exterior surface forming said underside of said trader desk work surface.

6. The combination set forth in claim 3, wherein:

said vertical portion is longer than said horizontal portion; and a section of said sloped portion proximate said free end is bent to form a lip.

7. The combination set forth in claim 3, wherein said horizontal portion is longer than said vertical portion.

8. In combination, a nosing assembly and a trader desk work surface having an underside and a front end portion with a first exterior surface, comprising:

a lower block having a second exterior surface, said lower block directly attached to said. Underside of said trader desk work surface; and a nosing attached to said first and second exterior surfaces, said nosing substantially surrounding and conforming to said first and second exterior surface, said nosing including..:

a. a first horizontal portion extending frontwardly;

b. a vertical portion integral with said first horizontal portion, said vertical portion extending vertically downwardly from a terminal end of said first horizontal portion;

c. a second horizontal portion integral with said vertical portion and extending rearwardly; and d. a sloped portion integral with said second horizontal portion, said sloped portion extending downwardly at an angle to said second horizontal portion from an end thereof;

whereby said trader desk work surface is provided with a nosing to protect said trader desk work surface and users thereof.

9. In combination, a nosing assembly and a trader desk work surface having an underside and a front end portion with a first....exterior surface .... Comprising:

a lower block having a second exterior surface, said lower block directly attached to said Underside of said trader desk work surface, and a nosing attached to said first and second exterior surfaces, said nosing substantially surrounding and conforming to said first and second exterior surfaces, said nosing including::

a. an arcuate portion including a horizontal leg and a vertical leg; and b. a sloped portion integral with said vertical leg, said sloped portion extending downwardly at an angle to said vertical leg from an end thereof and terminating in a free end;

whereby said trader desk work surface is provided with a nosing to protect said trader desk work surface and users thereof.

10. The combination set forth in claim 9, wherein:

said vertical leg is longer than said horizontal leg; and a section of said sloped portion proximate said free end is bent to form a lip.

11. The combination set forth in claim 9, wherein said horizontal leg is longer than said vertical leg.

12. In combination, a nosing assembly and a trader desk work surface having an underside and a front end portion with a first exterior surface, comprising:

a lower block having a second exterior surface, said lower block directly attached to said underside of said trader desk work surface;

a nosing attached to said first and second exterior surfaces, said nosing substantially surrounding and conforming to said first and second exterior surfaces; and a spacer block attached to said underside rearwardly of said lower block.

* * * * *